United States Patent [19]

Kuplas

[11] Patent Number: 4,539,026

[45] Date of Patent: Sep. 3, 1985

[54] SUCTION CLEANER BAG

[75] Inventor: Harbey Kuplas, North Wembley, England

[73] Assignee: The Hoover Company, North Canton, Ohio

[21] Appl. No.: 568,898

[22] Filed: Jan. 6, 1984

Related U.S. Application Data

[62] Division of Ser. No. 374,161, May 3, 1982, Pat. No. 4,452,618.

[30] Foreign Application Priority Data

May 7, 1981 [GB] United Kingdom ..... 8113955
Dec. 10, 1981 [GB] United Kingdom ..... 8137344

[51] Int. Cl.[3] ..... B01D 46/02; B01D 46/52

[52] U.S. Cl. ..... 55/376; 55/374; 55/DIG. 2

[58] Field of Search ..... 55/374, 376, 377, 378, 55/DIG. 2

[56] References Cited

U.S. PATENT DOCUMENTS

| | | | |
|---|---|---|---|
| 1,380,907 | 6/1921 | Hoover | 55/374 |
| 1,443,449 | 1/1923 | Wise et al. | 55/374 X |
| 2,646,855 | 7/1953 | Senne | 55/373 X |
| 2,847,084 | 8/1958 | Wolfskill et al. | 55/374 X |
| 2,975,862 | 3/1961 | Goldberg | 55/DIG. 2 X |
| 2,995,206 | 8/1961 | Smithson | 55/376 |
| 3,328,942 | 7/1967 | Waters | 55/377 X |
| 3,616,621 | 11/1971 | Fesco | 55/376 X |

*Primary Examiner*—Kathleen J. Prunner
*Attorney, Agent, or Firm*—Gerald H. Kreske; Richardson B. Farley

[57] ABSTRACT

A dirt collecting bag is disclosed having a face plate or collar with a slotted configuration along one of its edges to aid in mechanical transfer of it from a storage magazine to a bag mounting and transfer apparatus in a vacuum cleaner.

3 Claims, 10 Drawing Figures

SUCTION CLEANER BAG

CONTINUING STATUS

This application is a divisional of application Ser. No. 374,161, filed May 3, 1982, now U.S. Pat. No. 4,452,618 titled Suction Cleaners with a Bag Transfer Arrangement and owned by a common assignee.

BACKGROUND OF THE INVENTION

1. Field of the Invention

The invention is directed to cleaner bag loading in a cleaner and, more specifically, to a dirt collecting bag having a collar adapted for bag transfer to an operative dirt collecting position.

2. Summary of the Prior Art

This invention relates to suction cleaners of the type which incorporate a disposable dirt bag usually made of porous paper. Many suction cleaners of this type have been manufactured, and proposed but not manufactured, in which the paper bags are manually inserted and removed from a cleaner casing. Generally speaking this involves awkward manual manipulation of the bag both during removal and insertion, and the user finds it difficult to keep his or her hands clean during this operation.

Thus, importance can be attached to a bag configuration which lends itself to transfer from a loading station to an operative position and then, upon filling, from the operative position to a position where the filled, dirt bag may be easily off loaded to free the loading station for yet another bag transfer to the operative position. No known prior art has been found which provides a bag that accomplishes all these functions.

The patent to Senne (U.S. Pat. No. 2,646,855) would appear to be closest to this requirement. In it, a slotted collar is presented which serves as a release, and guide for the bag as it slides down a partially arcuate guideway in the Cleaner but the slotted collar must first be moved axially by the transfer mechanism to place it in position for its guiding function so that it is not easily transferred from its bag magazine to its bag mounting arrangement.

Accordingly, it would be advantageous to efficiently conform a bag collar for ease in movement to and between the positions just described.

It would be a further advantage to provide the aforesaid bag conformance by effective shaping of the bag collar.

It would be a further advantage to provide hook portions on the bag collar to serve as a handy releasable fastening means to permit automatic bag transfer movement between at least some of its positions.

SUMMARY OF THE INVENTION

The invention comtemplates a bag including a cardboard collar or the like which is disposed in a non-axial manner on the bag. Thus, the collar may include projecting portions that extend beyond the bag side so as to clear the bag, proper. These projecting portions take the form, at their bottoms, of hook-shaped projections above which are disposed slots close to the bag edge margin. The slots releasingly lodge hooks on a cleaner magazine that stores the bag prior to their release and transfer to a bag mounting means that places the bags, one at a time, in an operative dirt receiving position.

The hook portions of the bag collar deform downwardly during bag release from rigid hooks on the storage cleaner magazine to permit movement of the bags, individually, to the operative position.

BRIEF DESCRIPTION OF THE DRAWINGS

Reference may now be had to the accompanying drawings for a better understanding of the invention, both to its organization and function, with the illustration being only exemplary, and in which.

DETAILED DESCRIPTION OF THE INVENTION

Figure 1:
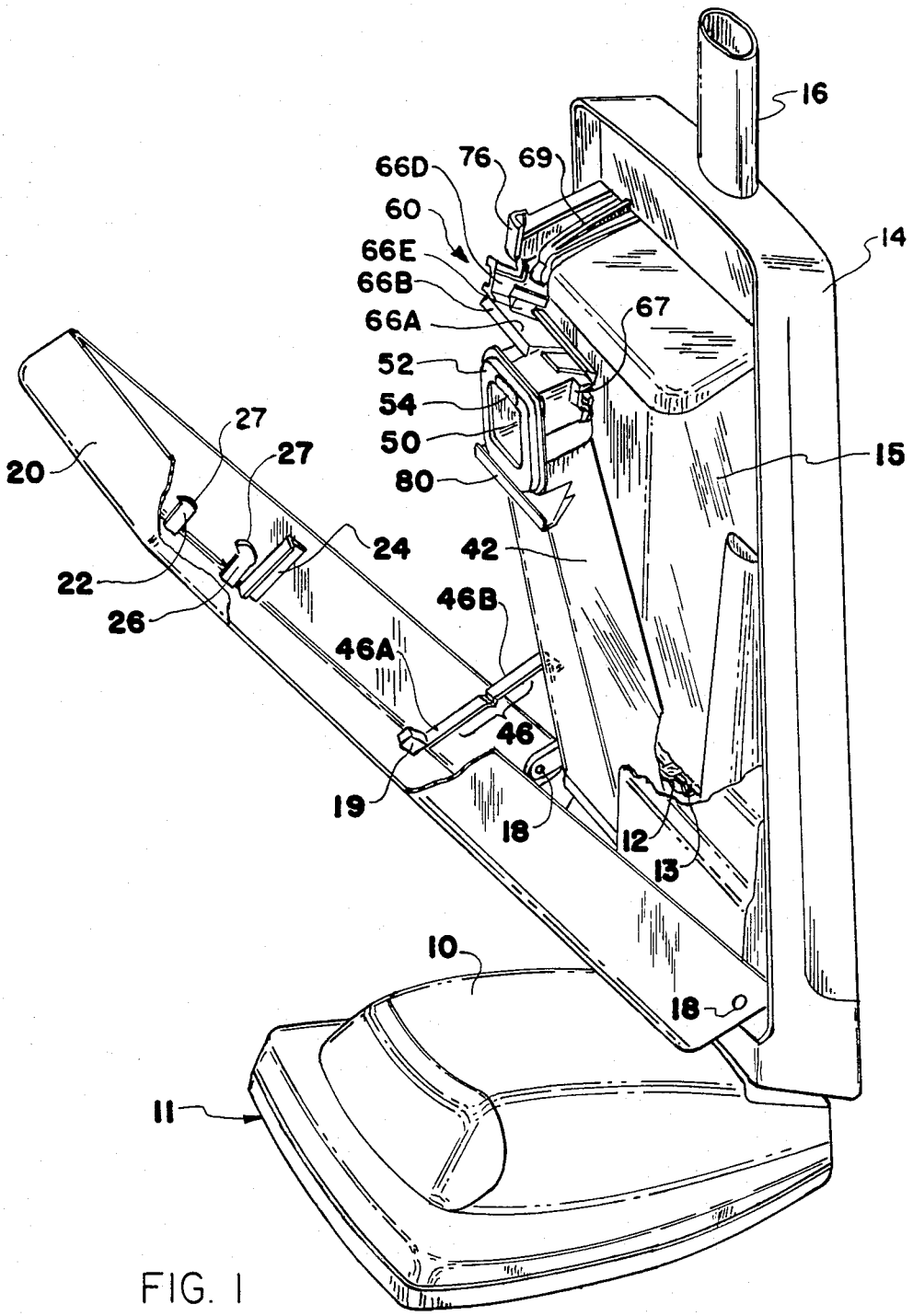
FIG. 1 is a perspective view of a preferred form of an upright suction cleaner, usable with the inventive bag and with a door in an open position and with certain parts broken away.
Figure 2:
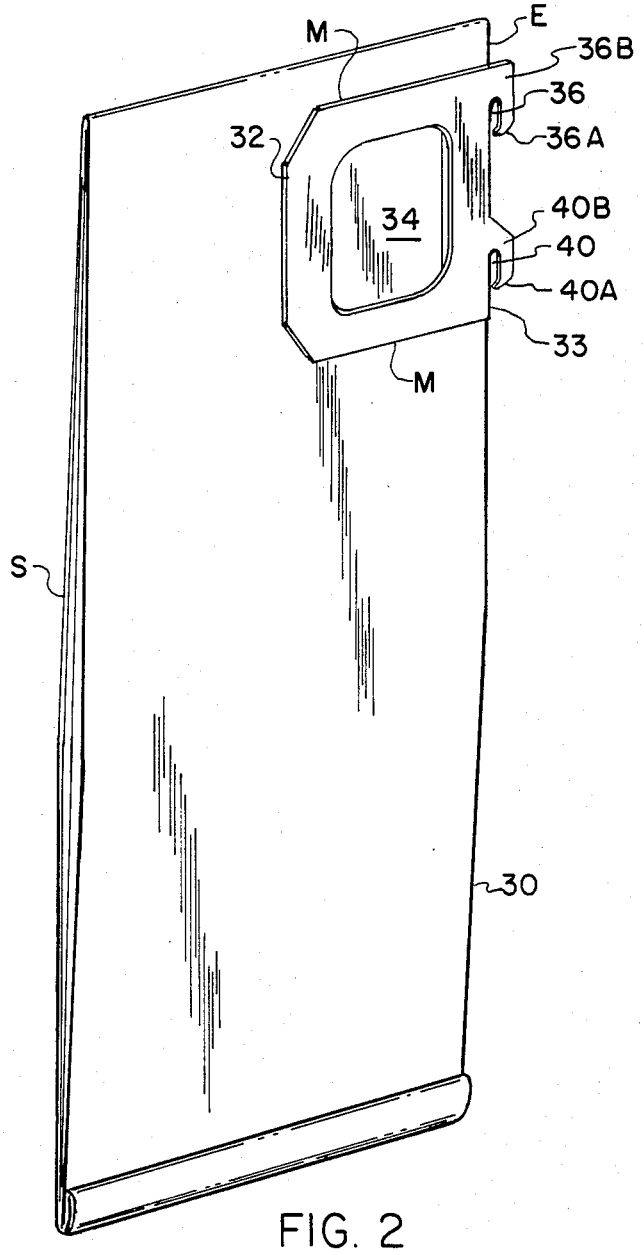
FIG. 2 is a perspective view of a paper bag with a cardboard collar secured thereto which is utilized in the cleaner of FIG. 1 and which is in accordance with the invention.

The preferred embodiment of the invention shown in FIGS. 1–10 of the drawings is applied to a fairly conventional upright cleaner having a lower casing 10 housing a motor fan or suction unit which is arranged to drive an an agitator situated at a forward suction nozzle 11. The lower casing 10 is mounted on a pair of forward wheels and a pair of rear wheels which are not visible in the drawings.

Extending upwards from the rear of the lower casing 10 is an upright, generally rectangular, casing 14 forming a cavity 15 serving as a dirt collecting bag receiving cavity or as a dirt bag receptacle which is of a rigid nature and which is surmounted by a handle 16. The casing 14 is secured in its upright position of FIG. 1 in a conventional manner by a latch, which can be released by a foot pedal not shown.

The casing 14 has a door 20 pivoted at its lower end about a horizontal axis on pivots 18. The door extends for the full height of the front of the casing 14 and is shown in an open position in FIG. 1. The door also serves as a bag carrier. For this purpose it has two tongues 22 and 26 arranged in the same vertical plane, for mounting a series of five paper bags of the type shown in FIG. 2. Each tongue has a hook-like enlargement 27 at its tip.

In one preferred form the bag 30 is generally conventional insofar as it is produced as a flattened tube of porous paper with pleated sides S to permit of expansion upon inflation of the bag during operation of the cleaner. The lower edge of the bag may be folded and sealed as by gluing.

During manufacture an apertured collar 32 formed from relatively stiff material, such as cardboard, is fastened to a wall of the bag, close to an edge region E where the bag has an entry area or aperture 34 for inflow of dirt-laden air. This edge location of the collar is necessary in the particular arrangement illustrated since the collar offers side suspension of the bag during storage in a cleaner. Thus the collar may be regarded as offset with respect to the bag's longitudinal axis.

Figure 6:
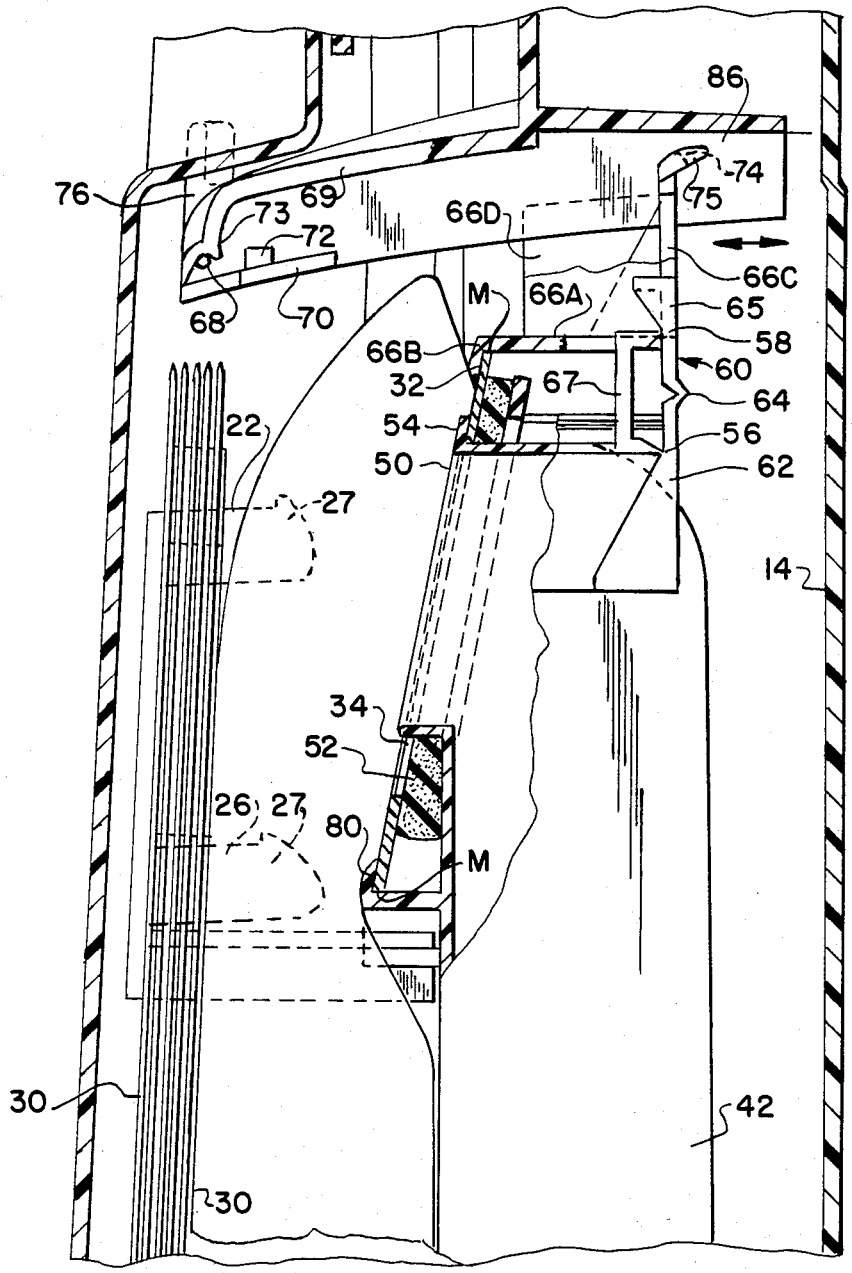
FIG. 6 is a sectional side elevation of part of the cleaner, with its door closed and the bag mount in the operative region.

The collar 32 includes at least one edge 33, preferably straight, and is provided with two tabs 36B and 40B extending juttingly outwardly of the edge 33 and extending generally parallel thereto and including two hook-shaped portions 36A, 40A, such that slots 36, 40 are formed between the tabs 36B and 40B and edge 33 to permit the bag to be loaded onto and located upon a bag-carrier structure within a suction cleaner. The two tabs 36B and 40B are in end to end relation and are aligned with each other as are the two hook-shaped portions 36A and 40A and the two slots 36 and 40. These elements also can be described as axially and/or vertically aligned with each other. Preferably a marginal edge portion M of the collar (which includes edge 33) at least at the uppermost and lowermost areas thereof, is not secured to the bag wall, i.e., is left free for engagement of bag-securing latches 66B, 80 (FIG. 6). FIG. 1 illustrates a suitable bag-carrier structure comprising a door 20 pivoted about a generally horizontal axis upon pivots 18. A tongue 22, with a further tongue 26 protruding below, but in the same generally vertical plane as tongue 22, together provide supports upon which a number of bags 30 (FIG. 6) can be suspended, with the tongues passing into the slots 36, 40 respectively. Each tongue 22, 26 has a shouldered enlargement 27 (see, e.g., FIG. 6) at its end, and the vertical height of the enlargement 27 is greater than the vertical length of the slots 36, 40. This enlargement assists in retaining the bags upon the tongues during storage of the bags within the cleaner, and the dimensions of the slots 36, 40 in the bag collar are just adequate to accept the non-enlarged portions of the tongues 22, 26.

Since the slots 36, 40 terminate at one end with the respective hook-shaped portions 36A, 40A, these latter portions have sufficient give or flexibility to permit slight deformation thereof, so enabling the bags to be loaded onto the tongues 22, 26 for bag storage purposes, but also to be automatically removed from the tongues and past the enlargements 27, to be secured to an exhaust air duct during bag transfer operations.

During bag transfer movements the bags are automatically lifted slightly upwards, slightly away from, and just free of the tongues 22, 26, and this movement produces deformation of the hook-shaped portions 36A, 40A, as the bags negotiate the enlargements 27. That is, as the leading bag is being mechanically lifted off of the tongues, the slots 36, 40 need to be effectively opened at their lowermost ends by deforming the hook-shaped portions 36A, 40A, (generally downwardly, counterclockwise) thus elongating the slots and permitting those slots to pass over the enlarged tongue ends.

The door 20 acts as a magazine containing five bags with the cardboard collars 32 supported on the hooks 22, 26 and facing rearwards. The closing of the door from the position of FIG. 1 automatically latches the rearmost bag collar onto the bag mount by means of a mechanism contained within the casing 14 in a manner to be described.

In addition to the two bag-supporting tongues, 22 and 26, the door carries a locating prong 24 for a purpose described later.

The casing 14 has extending upwardly therein an exhaust air fill tube or air conduit 42 of a rigid tubular nature connected at its lower end by a bellows, not shown, to an exhaust opening extending from the outlet of the motor fan unit. At the back of the fill tube 42 near the bottom is a downwardly facing lip 12 which resets on a ledge 13 in the casing 14 to form a pivot having a horizontal axis. This pivotal axis is to the rear of the axis of the pivots 18 of the door 20 so that points on the fill tube 42 and on the door 20 which are equidistant from the respective pivot axes move along different axes. Somewhat above the level of the pivots 18, the door 20 is connected to one side of the fill tube 42 by means of a strap 46. The rear portion of the strap 46 is integral with the fill tube being parts of a one-piece moulding of a suitable plastics material such as polypropylene. The front end portion of the strap is secured to the door 20 at 19, e.g. by a screw. Spaced apart along the length of the strap between the end portions are three living hinges, i.e. transverse strips of reduced thickness, defining two intermediate hinged portions, 46A and 46B.

The fill tube 42 constitutes a bag mount. It extends upwards within the casing 14 and terminates in a forwardly facing outlet 50 which is surrounded by a seal 52 formed of foam plastics. Upstanding from the top forward edge of the opening 50 in front of the upper portion of the seal 52 is a hook 54. The hook 54 is not secured to the seal 52 so that, as will be described, the cardboard collar 32 of a bag can be addressed up against the seal 52 and the seal 52 compressed to the position shown in FIG. 10, at which time the collar 32 of the bag lies in a plane slightly behind the hook 54. The bag and collar achieve this position during the closing movement of the door to the position of FIG. 6.

Moulded integrally with the rear upper end of the fill tube 42 are bag securing means. These means comprise a movable bag latching assembly generally indicated at 60, which includes lateral lugs 62 to which are connected, via living hinges 64, an upper latch member which includes a generally horizontal portion 66A projecting from a rear wall 65, and a downwardly turned latch 66B, together with a rear tab 66C upstanding from the rear wall 65. The member 66 also comprises a pair of vertical webs 66D and 66E shown most clearly in FIG. 3.

Figure 8:
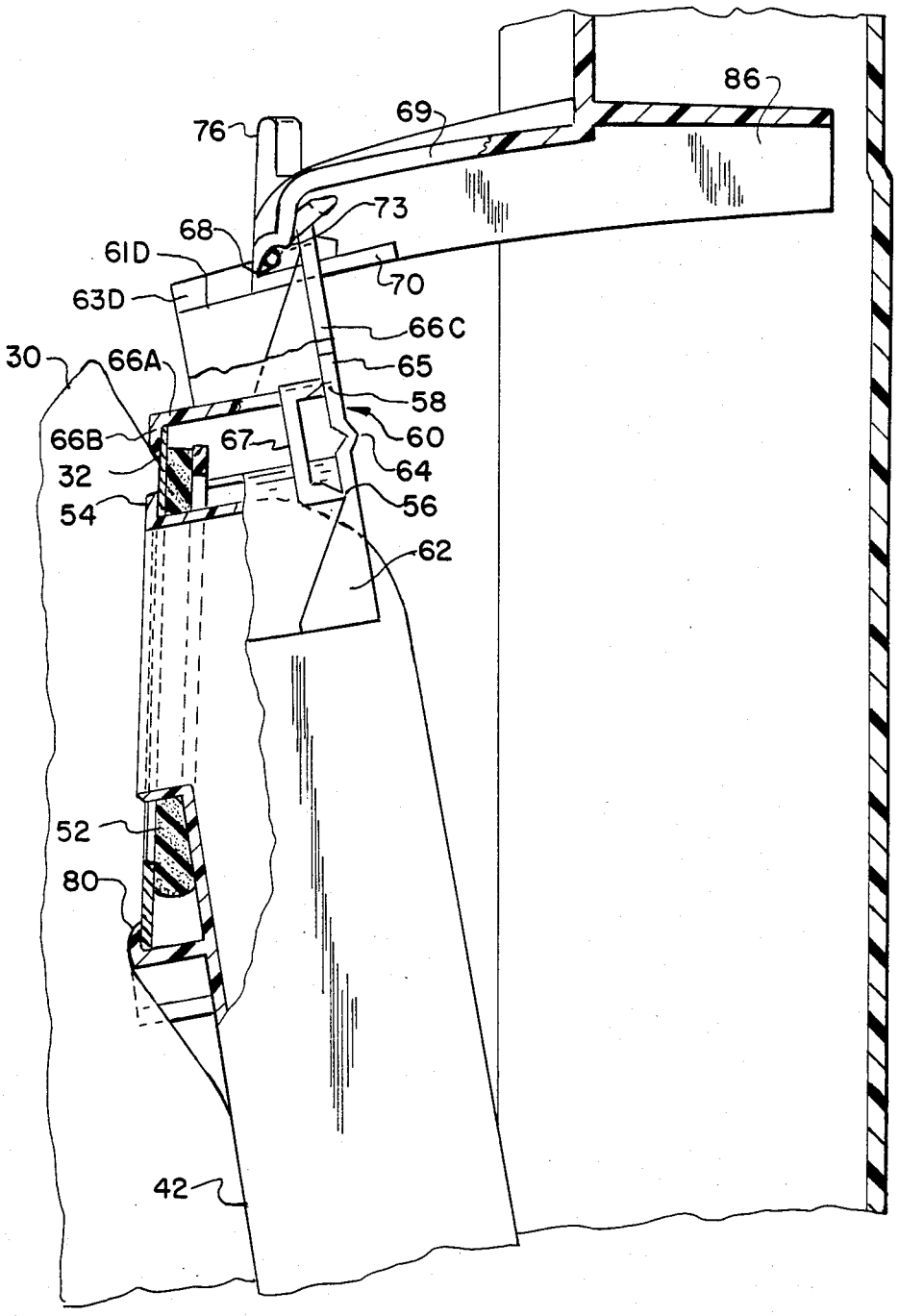
FIG. 8 is a sectional side elevation of the same part showing the bag mount about to reach the bag unloading position.
Figure 9:
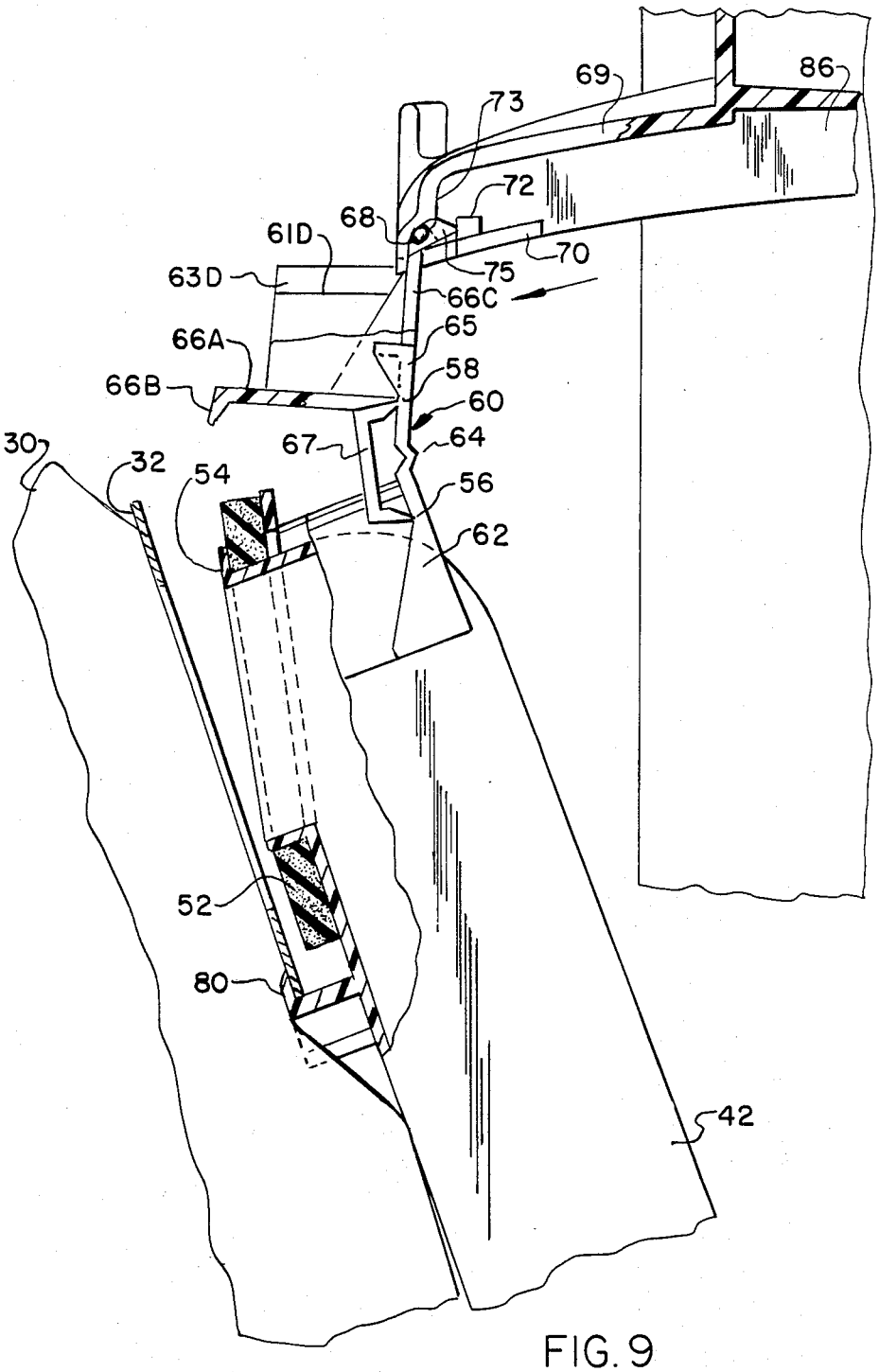
FIG. 9 is a sectional side elevation of the same part in the bag unloading position in which the bag is ready to be removed by hand from the cleaner.

The upper latch member also includes, at each side of the member and bridging the hinge 64, a roughly C-shaped integral spring portion 67. The lower limb of the C is connected to the corresponding lateral lug 62 by a lower living hinge 56, and the upper limb of the C is connected to a rear wall 65 by an upper living hinge 58. When the rear wall 65 is in alignment with the lateral lugs 62, as shown in FIGS. 6, 7, 8 and 10, the spring portion 67 is virtually unstressed. When, however, the rear wall 65 is forced into an inclined position relative to the lateral lugs 62, accompanied by flexure at the living hinges 64, as shown in FIGS. 1 and 9, the locus of movement of the upper living hinge 58 is along an arc struck about the living hinge 64, so the distance between the upper and lower living hinges 56 and 58 is reduced and each C-shaped spring portion 67 is distorted. The reaction to this strain on the spring portions 67 is to apply a restoring force tending to urge the rear wall 65 back into alignment with the lateral lugs 62.

Figure 4:
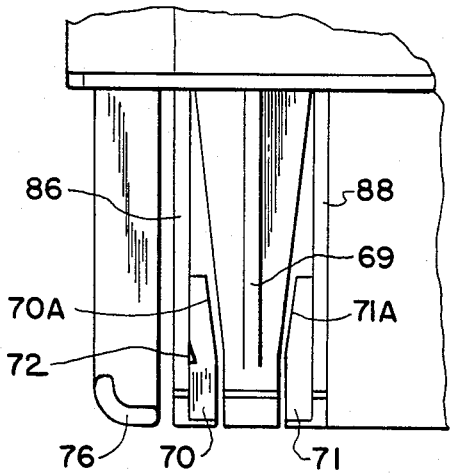
FIG. 4 is a plan view of a fixed portion of the suction cleaner, which co-operates with the upper portion of the bag mount.
Figure 5:
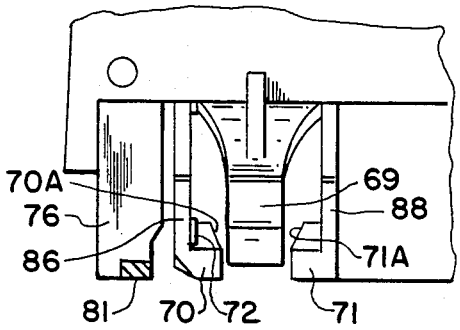
FIG. 5 is a front view of the fixed portion shown in FIG. 4.

Each of the vertical webs 66D and 66E has an upwardly facing arcuate surface 61D and 61E, and an inwardly facing vertical surface 63D and 63E, respectively. The arcuate surfaces 61D and 61E are struck about the horizontal pivotal axis of the fill tube 42, defined by the axis of engagement of the lip 12 with the ledge 13. In most positions of the fill tube, as shown in FIGS. 6, 7, 8 and 10, the arcuate surfaces are close to, or touching, corresponding arcuate surfaces on the bottom edges of parallel guides 86 and 88 extending downwards from an upper interior part of the casing 14. These guides are also seen in FIGS. 4 and 5. The inwardly facing vertical surfaces 63D and 63E are close to, or touch the outer vertical surfaces of the guides 86 and 88, respectively, when the fill tube is in the positions of FIGS. 6, 7, 8 and 10. These guides thus aid in guiding the fill tube during its backward and forward pivotal movements.

The bag securing means also comprise, in addition to the movable bag latching assembly 60, a lower latch 80 (both may be considered latch portions) which is integral with, and immovable relatively to, the fill tube 42.

Beside the lower latch 80, and also integral with the fill tube 42, there is a laterally extending rib 23 (see FIG. 3) and an adjacent inverted L section formation 25. These are spaced apart to define a forwardly-facing inverted L section passage to receive the locating prong 24 on the door 20 when the latter is approaching its closed position, to ensure proper alignment of the fill tube 42 in relation to the door 20 carrying the bags 30, in the bag-transfer postion.

Figure 3:
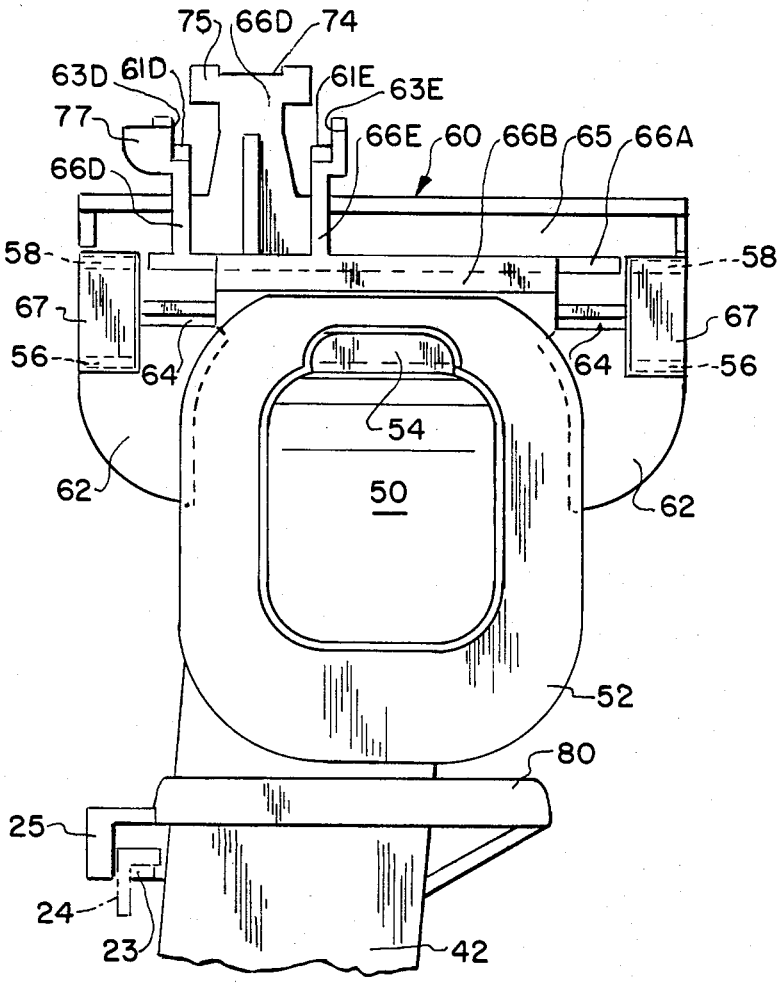
FIG. 3 is a front view of the upper portion of the bag mount of the upright suction cleaner of FIG. 1.

The upper end of the upstanding tab 66C of the movable latching assembly is approximately T-shaped when viewed from the front, as in FIG. 3, the cross-piece of the T being just narrow enough to pass freely between the guides 86 and 88. At its forward end, each guide 86 and 88 has on its lower inner edge an inwardly facing ledge 70 and 71, respectively. These ledges have inclined lead-in surfaces 70A and 71A, respectively. These serve to centralize the upstanding tab 66C as it approaches the forward end of the guides, e.g. as shown in FIG. 8. The guide 86 also has, above the ledge 70, a wedge-shaped detent 72. Between the guides 86 and 88 there is a forwardly projecting spring latch 69 having at its forward end a downwardly facing notch 68. Above the notch 68 the latch has a rearwardly facing vertical surface 73. In the center of the crosspiece of the upstanding tab 66C there is a lowered surface 74 adapted to be received in the notch 68 of the spring latch 69. On each side of the lowered surface 74 the ends of the crosspiece of the tab 66C extend rearwardly as lugs 75.

Figure 7:
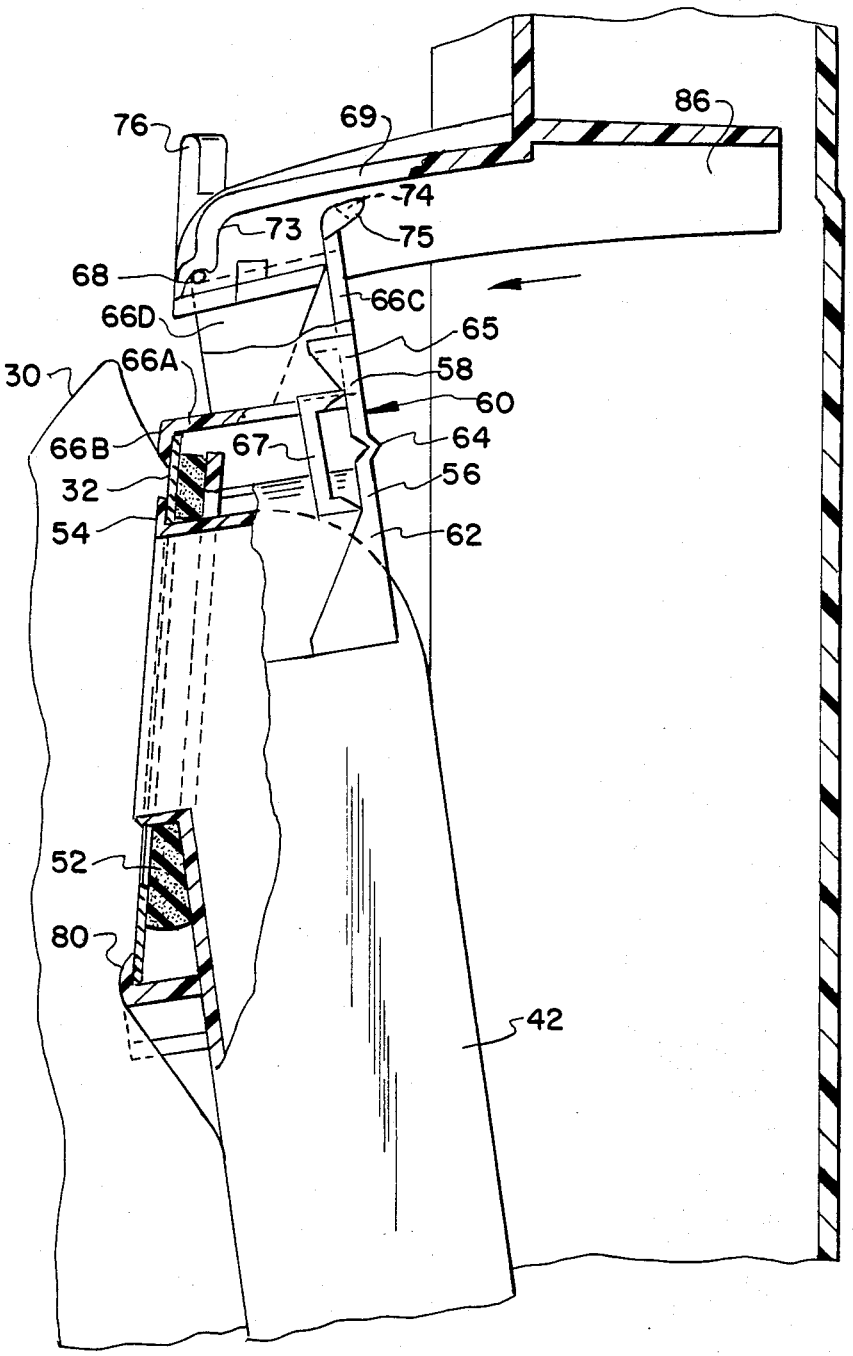
FIG. 7 is a sectional side elevation of the same part of the cleaner with the bag mount at the forward limit of the operative region.

Outside of the guide 86 there is a spring latch 76 which normally occupies the lower position shown in FIGS. 5, 6, 7 and 9, where it would obstruct forward movement of the fill tube 42 beyond the position shown in FIG. 7, the bottom of the latch 76 in this position lying across the path of a lateral lug 77 on the vertical web 66D of the movable latching assembly 60.

The automatic bag changing mechanism works as follows:

Assume that a bag 30 is already latched to the bag mount at the upper end of the fill tube 42, as shown in FIG. 6. The bag collar 32 is held with its bottom edge behind the fixed lower latch 80 and with its top edge behind the movable upper latc 66B, compressing the seal 52 and making a substantially airtight joint between the bag opening 34 and the fill tube outlet 50. Dirty air sucked into the cleaner through the suction nozzle 11 by the fan is blown up through the fill tube 42 and into the bag 30, where the dirt is filtered out, the clean air emerging through the bag walls and being returned to the room through apertures in the casing 14. The fill tube 42 can pivot freely back and forth throughout its operative region, between a rearmost position limited by the back wall of the casing 14, and a foremost position as shown in FIG. 7 where the lateral lug 77 on the vertical web 66D (FIG. 3) has come up against the bottom of the manually operable spring latch 76 (FIG. 5). This freedom of movement in the operative region permits the fill tube 42 to position itself to accommodate variations in the size of the bag 30 as it becomes increasingly full.

If the user wishes to inspect the bag, e.g. to see whether it is full enough to need changing, she can open the door 20. This draws the fill tube 42 and the bag 30 to the foremost limit of the operative region as shown in FIG. 7. The spring latch 76 prevents the fill tube and bag from moving beyond the FIG. 7 position. If the bag does not require changing, the user closes the door and the parts revert to the FIG. 6 condition.

If the bag is full, the user raises the spring latch 76 and opens the door further, to allow the lateral lug 77 to pass beneath the latch 76. The latch is then released and springs down behind the lateral lug, allowing the fill tube 42 to be drawn further forward as shown in FIG. 8. During this movement the upstanding tab 66C passes between the ledges 70, 71 of the guides 86 and 88 (FIGS. 4 and 5), ensuring that the tab 66C and hence the bag mount as a whole, are properly centered laterally. In the FIG. 8 position, the top of the tab 66C has made contact with the vertical surface 73 of the spring latch 69. The lug 75 on the side of the tab 66C nearest the guide 86 has passed above the wedge-shaped detent 72 on this guide. The bag collar 32 is still held between the lower fixed latch 80 and the upper movable latch 66B.

On opening the door further, the fill tube 42 continues to be drawn forward from the FIG. 8 position, but the top of the tab 66C cannot partake of this movement, being restrained by the vertical surface 73 of the spring latch 69. This further movement therefore causes the upper portions of the bag latch assembly 60, namely all the portions above the living hinges 64, to be tilted upwards relative to the portions below the hinges 64, as shown in FIG. 9. This raises the movable upper latch 66B well clear of the bag collar 32, allowing the seal 52 to expand and allowing the bag to be lifted clear of the fixed lower latch 80 and removed from the cleaner. This tilting movement of the upper portions of the latch assembly causes the tab 66C to slide down the vertical surface 73 until the lowered surface 74 of the tab enters the notch 68 of the spring latch 69. Also, the lug 77 of the tab which passed over the detent 72 is brought down to lie in front of the detent as shown.

For automatic replacement of the removed full bag by a new one from the magazine on the door, all the user has to do is to re-close the door. During the first part of the door re-closing movement the fill tube 42 is held against rearward movement because the lug 75 of the tab 66C is restrained against such rearward movement by the detent 72. What this part of the door re-closing movement does is to present the collar 32 of the rearmost bag in the magazine against the seal 52. The arrangement is such that the upper edge of the opening in the collar 32 just clears the hook 54 of the bag mount, and the bottom edge of the collar just clears the fixed lower latch 80. Because the door 20 and the fill tube 42 pivot about different horizontal axes, they move on different axes. When the collar 32 has engaged the seal 52 the arc of movement of the fill tube and hence of the seal is rising relative to the arc of movement of the door. At first this causes the hook 54 and the latch 80 to rise relative to the collar 32 and so entrap the collar. This entrapment, and the friction between the collar and the seal, will then cause the collar to follow the arc of movement of the fill tube 42 rather than that of the door. This has the effect of lifting the collar relatively to the door, particularly relative to the door tongues 22 and 26. This lifting movement is permitted by the partially open lower ends of the slots 36 and 40 in the collar, allowing the collar to be lifted over the hook-like tips 27 of the tongues while the bags still left in the magazine remain held by the tongues.

Figure 10:
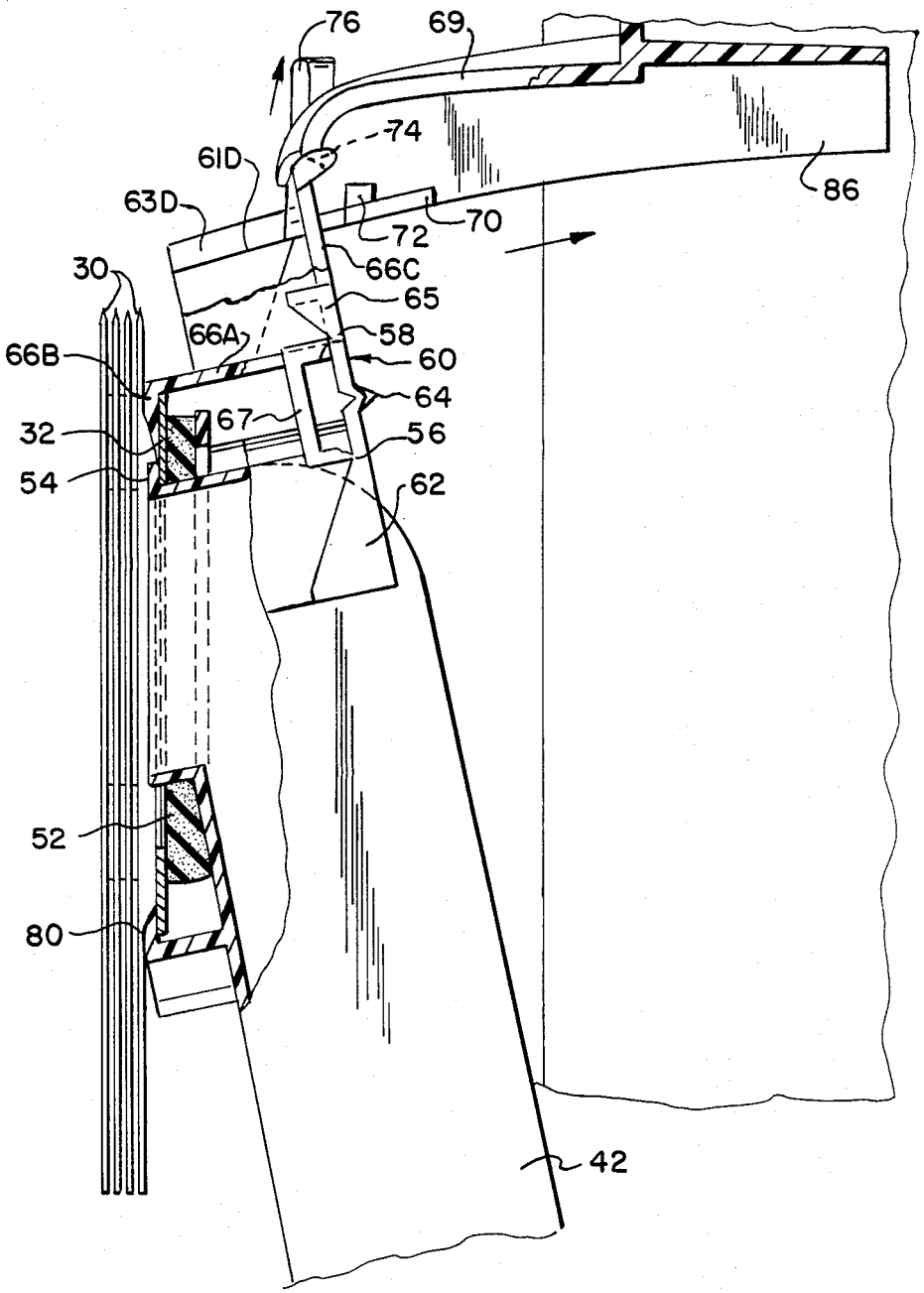
FIG. 10 is a sectional side elevation of the same part with a new bag just engaged by the bag mount.

A stronger closing force is then needed to close the door further. The effect of this is to straighten out the bag latching assembly about the hinges 64. This forces the tab 66C upwards, pressing it up against the spring latch 69. This latch is forced upwards as shown in FIG. 10, as the latching assembly is straightened. The straightening causes the upper parts of the assembly, above the hinges 64, to tilt downwards relative to the parts below the hinges 64 so that the upper latch 66B engages the top edge of the bag collar 32. The lugs 75 of the tab 66C are raised clear of the detent 72 which no longer resists rearward movement of the tab 66C. However, it is still restrained by its lowered surface 74 being engaged in the notch 68 of the spring latch 69.

A further push on the door 20 will force the lowered surface 74 of the tab 66C out of the notch 68, allowing the bag mount, to which the new bag is now latched in place, to move back into the operative region shown in FIGS. 6 and 7, as can be seen in FIG. 5, the right-hand front lower corner 81 of the manually operable latch 76 is chamfered to form a lead-in which is engaged by the lateral lug 77 of the vertical web 66D as the bag mount is moved rearwards, so that the lug 77 itself lifts the latch 76 and passes beneath it.

In this manner, therefore, the user of the cleaner only has periodically to load a magazine of five bags into the door and close the door of the cleaner in order to install the first bag in the cleaner. When requiring changing, the bags are removed in the manner indicated and the fresh bags installed simply by reclosing the door, the required deformation of the hooks occurring. The operator has no intricate assembly work to carry out and can keep his or her hands perfectly clean during the replacement operation. If in checking a bag after removal, the user finds that in fact it need to be replaced yet, the bag can be simply reinserted manually by direct engagement with the latching means rather than placing back of the tongues on the door.

It should be clear that the objects of the invention have been complied with and that many modifications could be made to it which would still fall within the spirit and purview of the description offered.

What is claimed is:

1. A pleated bag having an aperture therein and an apertured collar attached thereto about said bag aperture, and including;

(a) said collar having a margin extending therearound, (b) at least a first tab attached to the collar and extending along said margin and jutting outwardly from said margin, (c) said tab spaced outwardly from such margin to form a slot between said tab and said margin, (d) said first tab is formed in alignment with at least a second tab attached to said collar, (e) said second tab is spaced from said margin to form a slot therebetween and juts outwardly therefrom, (f) said tabs include a hook-shaped portion at their free ends, (g) said first tab and said second tab attached to a single edge of said margin and extending generally parallel thereto, and (h) said tabs being substantially aligned with each other in end to end relationship.

2. The pleated bag of claim 1 wherein;

(a) said first and second tabs are vertically spaced from each other.

3. The pleated bag of claim 1 wherein;

(a) said collar is disposed along one edge of said bag.

* * * * *